United States Patent [19]

Brewton et al.

[11] Patent Number: 4,653,355

[45] Date of Patent: Mar. 31, 1987

[54] DEVICE FOR REMOVING CHAMPAGNE CORKS FROM BOTTLES

[75] Inventors: Nolan Brewton; Gerhard J. Weiner, both of Walnut Creek; Helmut Resch, Martinez, all of Calif.

[73] Assignee: Mt. Diablo Tool and Die, Inc., Walnut Creek, Calif.

[21] Appl. No.: 711,784

[22] Filed: Mar. 14, 1985

[51] Int. Cl.[4] ..... B67B 7/06

[52] U.S. Cl. ..... 81/3.44; 81/3.29

[58] Field of Search ..... 81/3.44, 111, DIG 9, 81/3.29, 3.42, 3.55, 3.56

[56] References Cited

U.S. PATENT DOCUMENTS

| | | | |
|---|---|---|---|
| 1,754,717 | 4/1930 | Hughens | 81/DIG. 9 |
| 3,741,047 | 6/1973 | Kanowsky | 81/111 X |
| 4,275,621 | 6/1981 | Mallott | 81/111 |
| 4,442,735 | 4/1984 | Chance et al. | 81/3.44 |

*Primary Examiner*—Roscoe V. Parker

*Attorney, Agent, or Firm*—Townsend and Townsend

[57] ABSTRACT

A device having a pair of hollow, shell-like members pivotally coupled to each other for movement into and out of positions adjacent to each other. When the members are adjacent to each other, they form a hollow space for receiving the cork in the neck of a champagne bottle, the members having flanges for defining an opening for receiving and surrounding the neck and underlying the annular lower extremity of the cork. A pair of resilient tabs are secured to the opposite ends of the members for releasably holding the same in their closed positions. A handle on one of the members is provided to allow for an outward force to be exerted on the members away from the bottle to move the cork out of the bottle when the cork is in the closed space formed by the members. The device can be formed of metal or plastic.

3 Claims, 4 Drawing Figures

DEVICE FOR REMOVING CHAMPAGNE CORKS FROM BOTTLES

This invention relates to improvements in cork removal devices for bottles, especially a device for removing the cork from a champagne bottle.

BACKGROUND OF THE INVENTION

Champagne corks are often removed from champagne bottles with disastrous results. Injuries to the eyes from flying corks from bottles of this type are not uncommon. A need continues to exist for improvements in cork removal devices which are not only safe and easy to use but which are simple and rugged in construction and can be made at minimum cost from metal or plastic. The present invention satisfies the need for such a device.

SUMMARY OF THE INVENTION

The present invention is directed to an improved device for removing the cork from a champagne bottle wherein the device includes a pair of hollow, shell-like members having hinge means at adjacent first end walls of the members for allowing the members to move toward and away from each other. When the members are adjacent to each other, they form a closed space for receiving and surrounding a cork to be removed from the neck of a bottle. The members have mating flanges defining a central hole for receiving the neck of the bottle when the cork is in the interior of the closed space formed also by the members. Resilient tabs at the opposite ends of the members frictionally engage each other to releasably hold the members together during the cork removal step. A handle on one of the members is used to pull outwardly on the members when the members form the closed space for the cork. In this way, the cork of a champagne bottle can be quickly, safely and easily removed from the neck of the bottle yet the device is of simple and rugged construction and can be used over and over again without replacement.

The primary object of the present invention is to provide an improved device for removing corks from champagne bottles wherein the device is simple and rugged in construction, is made from a relatively few number of parts, and can be used safely without injury to the user or to persons nearby.

Other objections of this invention will become apparent as the following specification progresses, reference being had to the accompanying drawings for an illustration of the invention.

IN THE DRAWING

Figure 1:
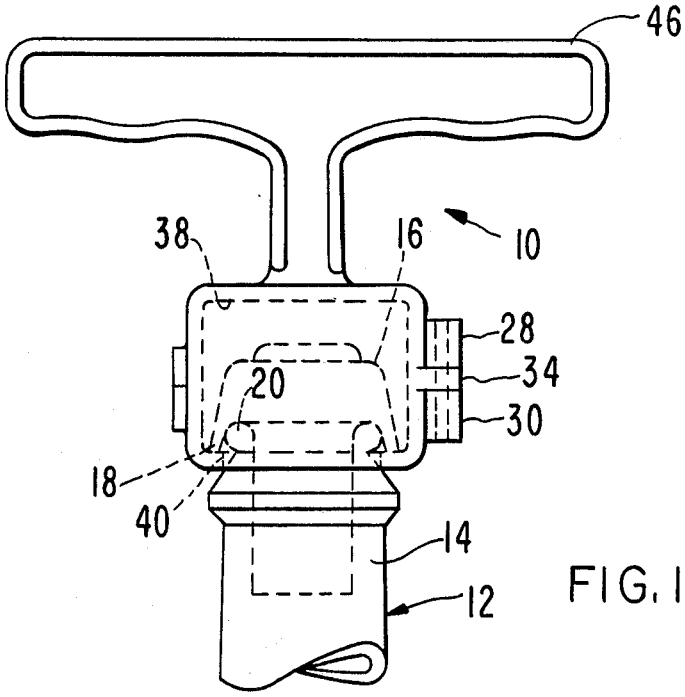
FIG. 1 is a side-elevational view of the device of the present invention showing the way in which it is removably coupled to the cork of a champagne bottle for removing the cork.

The device for removing a cork from a champagne bottle is broadly denoted by the numeral 10 and is adapted for use with a bottle 12 having a neck 14 which is stoppered by a cork 16 having an annular lower wall 18 surrounding the upper end 20 of the neck 14. Device 10 is to be mounted on neck 14 so that a part of the device surrounds the adjacent part of the cork and the neck, and another part of the device underlies the lower margin of annular wall 18. Thus, by an upward pull on device 10, cork 16 will be lifted out of closing relationship to the upper open top of neck 14 and the champagne bottle will be safely and quickly opened to allow the contents of the bottle to be poured therefrom.

Figure 4:
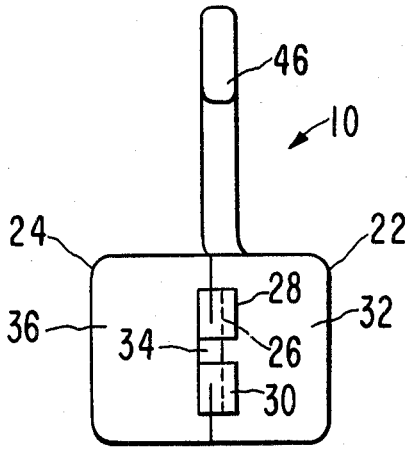
FIG. 4 is a view similar to FIG. 2 but showing a view of the opposite end of the device.

Device 10 includes a pair of shell-like members 22 and 24 which are hingedly coupled to each other by a pin 26 at one side of the device as shown in FIGS. 1 and 4. Pin 26 is received at its ends in a pair of tubular hinge elements 28 and 30 which are integral with the side wall 32 of member 22. The pin also extends through a third hinge element 34 integral with the side wall 36 of member 24. In this way, member 24 is hingedly mounted by pin 26 on member 22 so that the members can move relative to and toward each other to form a closed space 38 (FIG. 1) for receiving cork 16.

When they are together, members 22 and 24 define a bottom opening 40 (FIGS. 1, 2 and 3) which receives the adjacent portion of neck 14 so that cork 16 and annular lower wall 18 of cork 16 are within space 38 with the bottom margin of wall 18 of cork 16 overlying a flange 42 on member 22 and a flange 44 on member 24. These flanges are shown in dashed lines in FIG. 3. When the flanges 42 and 44 underly wall 18, the flanges can engage the wall and lift the cork out of the bottle when an upward force is applied by way of a handle 46 rigidly secured to member 22 as shown in FIGS. 1–4.

Figure 2:
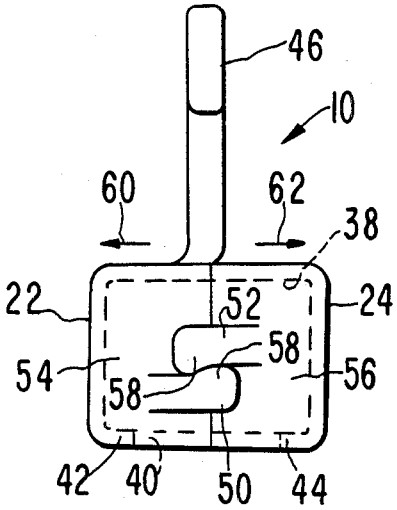
FIG. 2 is an elevational view of the device of FIG. 1, looking in the direction toward one end thereof.
Figure 3:
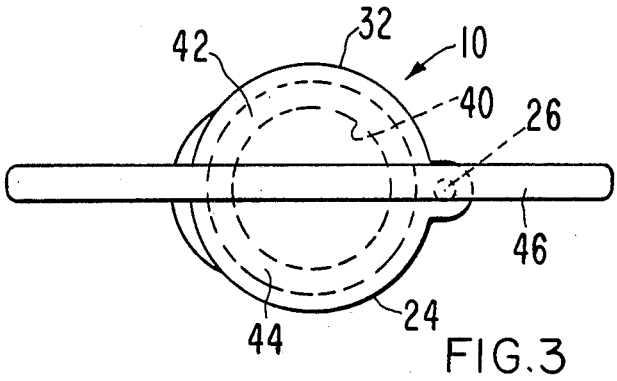
FIG. 3 is a top plan view of the device of FIG. 1.

A pair of tabs 50 and 52 are carried by end walls 54 and 56 of members 22 and 24, respectively, as shown in FIGS. 2 and 3. The tabs are resilient and yield relative to each other, the yielding being achieved by virtue of the resilience of the tabs. Each tab has a lateral projection which frictionally engages the projection of the other tab. When positioned in the manner shown in FIG. 2, the tabs 50 and 52 releasably lock members 22 and 24 in their closed positions and an outward force can then be applied to the handle 46 to pull on the device and thereby move the cork out of the bottle. After the cork has been separated from the bottle, members 22 and 24 can be opened or separated from each other by merely pulling them apart by applying a force on each member in the opposite directions indicated by arrows 60 and 62 (FIG. 2). Then, after the members are opened or separated, the cork can be removed and the device is now again ready for use to remove a cork from a champagne bottle.

The device can be made of metal or plastic. If made of plastic, the material will be of rigid, non-yielding material, such as a polycarbonate, which can be readily molded. Moreover, the parts can be readily assembled inasmuch as device 10 is comprised of a relatively few number of parts.

The present invention can be used without any special skills on the part of the user. The device is quickly and easily placed on a cork 16 in bottle 12 and, once the members 22 and 24 are closed and surround the cork as shown in FIG. 1, a pull by handle 46 on the cork is all that is required to lift the cork out of the bottle. The cork does not become separated from device 10 during the removal of the cork from the bottle since the members are releasably locked together by tabs 50 and 52; thus, there is no danger of the cork striking the person removing the cork or a person nearby.

We claim:

1. A device for removing a cork form a champagne bottle with the cork having an annular, lower marginal edge surrounding the neck of the bottle comprising:

a pair of shell-like members;

means hingedly coupling the members to each other for pivotal movement about a generally vertical axis from closed positions in which the members are adjacent to each other to open positions in which the members are spaced from each other, said members forming a closed space for receiving the cork of a champagne bottle when the members are in their closed positions, said members having flange means defining a hole for receiving the neck of the bottle and for engaging the lower marginal edge of the cork when the cork is received in said space;

a pair of resilient tabs, each tab being frictionally engageable with the other tab for releasably locking the members together when the members are in their closed positions; and a handle secured to and extending upwardly from one of the members for exerting a pulling force thereon so as to pull the cork out of the bottle when the cork is in said space.

2. A device as set forth in claim 1, wherein said coupling means includes a pivot pin, and a hinge element coupling the pivot pin to the adjacent side walls of said members.

3. A device for removing a cork from a champagne bottle with the cork having an annular, lower marginal edge surrounding the neck of the bottle comprising:

a pair of shell-like members, each member having a bottom wall and a curved flange defining a semi-circular recess through the bottom wall of the member;

means hingedly coupling the members to each other for pivotal movement about a generally vertical axis from closed positions in which the members are adjacent to each other to open positions in which the members are spaced from each other, said members forming a closed space for receiving the cork of a champagne bottle when the members are in their closed positions, the semi-circular recesses of respective members defining a hole for receiving the neck of the bottle and for engaging the lower marginal edge of the cork when the cork is received in said space, the flanges of the members mating with each other when the members are in the closed positions, whereby the flanges form the hole for receiving and surrounding the neck of the bottle;

means coupled with the members for releasably holding the same in their closed positions; and a handle secured to and extending upwardly from one of the members for exerting a pulling force thereon so as to pull the cork out of the bottle when the cork is in said space.

* * * * *